US005791662A

United States Patent [19]

Searby et al.

[11] Patent Number: 5,791,662

[45] Date of Patent: Aug. 11, 1998

[54] IN-LINE, INTERCHANGEABLE ROLLER-ICE SKATE

[76] Inventors: William Searby, 51 Koenig La., Freehold, N.J. 07728; Mark J. Cunard, 429 18th Ave., Brick, N.J. 08724

[21] Appl. No.: 856,919

[22] Filed: May 15, 1997

[51] Int. Cl.[6] ..... A63C 17/06

[52] U.S. Cl. ..... 280/7.13; 280/7.13; 280/11.27; 280/11.22

[58] Field of Search ..... 280/7.13, 11.27, 280/11.22

[56] References Cited

U.S. PATENT DOCUMENTS

| | | | |
|---|---|---|---|
| 226,835 | 4/1880 | Chesterman | 280/11.27 |
| 346,664 | 8/1886 | Libbey | 280/11.27 |
| 4,323,259 | 4/1982 | Boudreau | 280/7.13 |

*Primary Examiner*—Gary C. Hoge
*Assistant Examiner*—Clovia Hamilton
*Attorney, Agent, or Firm*—Charles I. Brodsky

[57] ABSTRACT

In in-line skating boots of the type incorporating an assembly in which roller wheels are held in alignment one-behind-another, a combination is described for replacing the roller wheels of the skating boot with an ice skating blade. In one embodiment of the invention, a single skating blade is held in position between two half-sections of a plurality of discs secured to the assembly, extending rearwardly of the last disc of the plurality and forwardly of the first disc of the plurality when locked in position. In a second embodiment of the invention, several individual blades are employed in alignment one-behind-another, with each individual blade held in position between the two half-sections of the plurality of discs utilized.

7 Claims, 4 Drawing Sheets

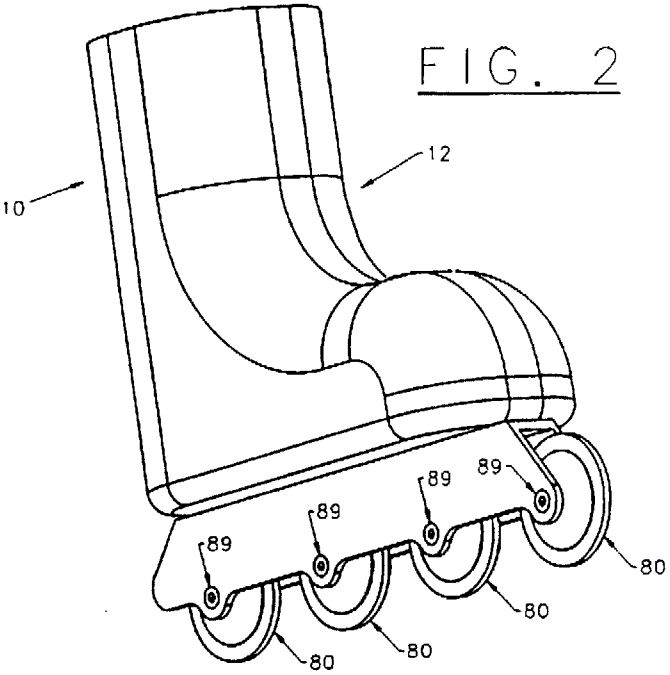
FIG. 2
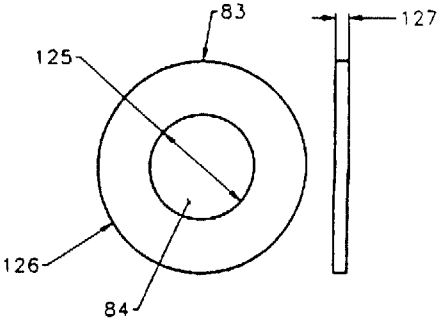
FIG. 18
FIG. 19
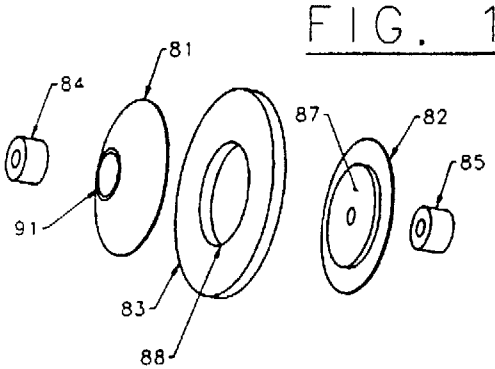
FIG. 14
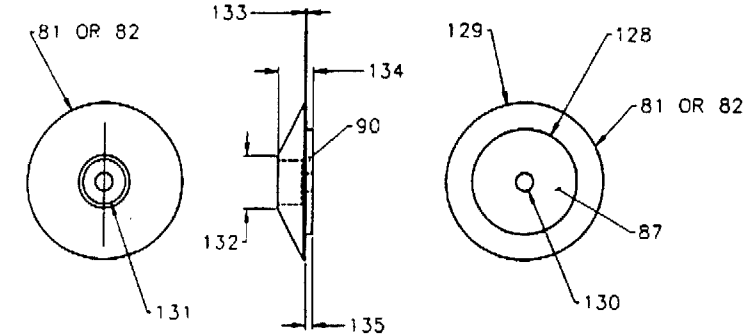
FIG. 15
FIG. 16
FIG. 17

14
30
22a
22b
24

14
23
24
20
20
21
75

35
104
34
36
37
38
100
105
2x
107

101
102
103

22a
22b
41
42
37
32
24

IN-LINE, INTERCHANGEABLE ROLLER-ICE SKATE

FIELD OF THE INVENTION

This invention relates to in-line skating and, more particularly to in-line skating boots of the type incorporating an assembly in which roller wheels are held in alignment one-behind-another.

BACKGROUND OF THE INVENTION

As is well known and understood, in-line skating boots of this type can cost anywhere from fifty dollars to several hundreds of dollars. As is also well known and understood, many persons prefer ice skating to roller skating, while others enjoy both types of recreational activities. For those people falling into the latter category, an additional expense arises in presently having to purchase a pair of ice skates to indulge in that type of activity—and, furthermore, possible pairs of hockey skates and figure skates when engaging in those sports. Thus, and at the very least, where the individual enjoys ice skating and wishes to partake in that sport, a second pair of ice skates—either hockey or figure—needs to be purchased. Where the individual wishes to participate in both forms of ice skating, then two pairs of ice skates are required, beyond the cost of the in-line roller skate. What with the comparably high prices for these ice skates as with the in-line roller skate, the skating enthusiast is thus called upon to spend several hundreds of dollars to fulfill their skating desires.

Obviously, it would be highly attractive if these skates could somehow be made interchangeable, one with another, so that only one pair of in-line boots need be purchased, and where the user can simply change from wheels to blades, and vice-versa, whenever desired.

OBJECTS OF THE INVENTION

It is an object of the present invention, therefore, to provide a new and improved skating boot usable for both in-line roller skating and for ice skating.

It is also an object of the invention to provide such a skating boot which can be utilized both for in-line roller skating and for either or both of ice hockey and ice figure skating.

It is another object of the invention to provide such a skating boot which can be easily changed from in-line roller skating to ice skating use, and back again, with a minimum of effort.

It is a further object of the invention to provide such a skating boot, which can be modified from in-line roller skating use to ice skating use, at a reasonable cost.

It is yet another object of the invention to provide such a skating boot in which the ice skating blade, once installed, is secured against both forward and rearward movement, as well as against side-to-side movement.

SUMMARY OF THE INVENTION

As will become clear from the following description, a combination is set forth for the replacement of the in-line roller wheels by a combination in which a plurality of discs are secured to its assembly, with each of the plurality of discs including two separable sections, between which an ice skating blade is removably insertable. As will be seen, the ice skating blade extends forwardly and rearwardly of the plurality of discs, with means being included to exert pressure against the two sections of the discs in compressing them against the skating blade to hold the blade in position. In one embodiment of the invention to be described, a single skating blade is held in position between the two half-sections of the plurality of discs, and when secured extends rearwardly of the last disc of the plurality and forwardly of the first disc of the plurality. In a second embodiment to be described, several individual blades are employed, in alignment one-behind-another, with each being held in position between the two half-sections of the plurality of discs utilized.

As will be seen, in the first embodiment of the invention, either an ice hockey blade or an ice figure skating blade can be inserted between the two half-sections and secured in place thereby, so as to extend in fixed position, locked in place. In the second embodiment, each individual blade is allowed to rotate and, about a shelf which extends from one of the two half-sections to join with the other half-section, passing through an opening in the individual blade, in an annular configuration. Primarily intended for speed skating purposes, this second embodiment of the invention will be seen to operate with half-sections of the plurality of discs which are notched, so as to secure the individual blades in position once inserted, both from front-to-back and from side-to-side. As will be noted, such notching of the half-section are present in the first embodiment of the invention as well, to again lock the skating blade in position, and preventing against unwanted movement thereof.

In accordance with the two embodiments to be described, one skilled in the art will observe that all that is necessary to switch from a roller skating usage to an ice skating usage, and vice-versa, is to remove the plurality of discs or wheels (as the case may be), and then replace them with the other. Of course, depending upon usage, the ice skating blade is to be inserted, for locking in place (when an ice skating function is desired), or removed, when being stored away where the roller skating use is desired.

BRIEF DESCRIPTION OF THE DRAWINGS

These and other features of the invention will be more clearly understood from a consideration of the following description, taken in connection with the accompanying drawings, in which:

FIG. 2 is perspective view of an in-line skating boot constructed in accordance with a second embodiment of the invention;

FIGS. 14–19 are helpful in an understanding of the in-line skating boot of FIG. 2.

DETAILED DESCRIPTION OF THE DRAWINGS

Figure 1:
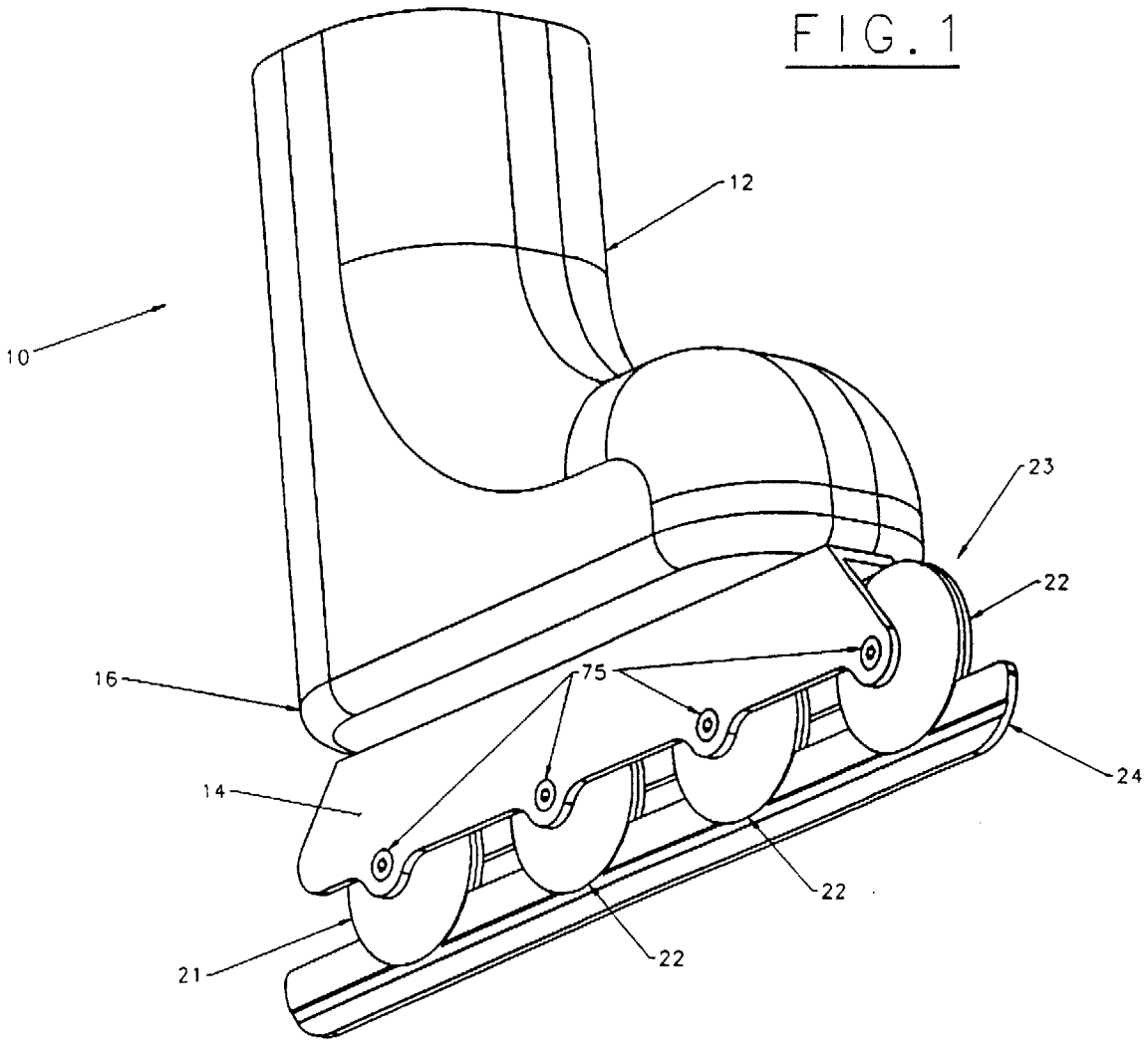
FIG. 1 is a perspective view of an in-line skating boot constructed in accordance with a first embodiment of the invention.

In each of FIGS. 1 and 2, reference numeral 10 identifies a type of in-line skating boot as is presently available, with an available type of securement or buckle arrangement identified at 12. As shown at 14, an assembly is provided at the underside 16 of boot 10 which typically holds the roller wheels as used in in-line skating. Such wheels (not shown) are typically held in place by any one of a number of securement means (also not shown), of a kind for unfastening to replace individual roller wheels when damaged, and for then securing them in position once replaced. As will be understood, in accordance with the invention, those types of fastening arrangements are each actuated when designed to replace the roller wheel with an ice skating blade according to the present invention. FIGS. 1 and 2 thus show preferred embodiments of the invention with the ice skating blade already inserted, and reattached to the skating boot 10, by means of the assembly 14, and appropriate fasteners. Such fasteners may, as an example, be inserted and then tightened or loosened, as the case may be, with an Allen-type wrench.

Figures 3, 4, 5, 6, 7, 8:
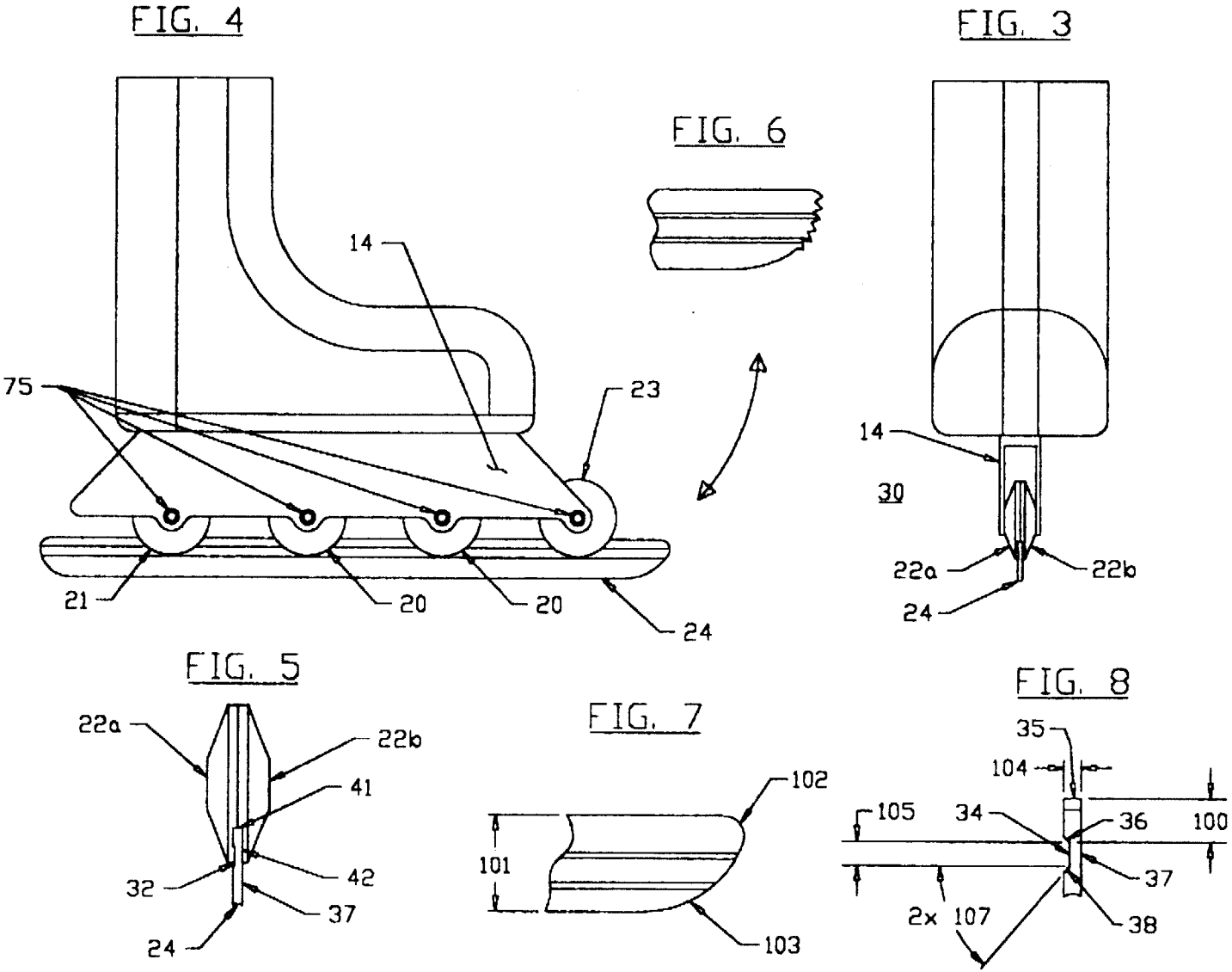
FIGS. 3 and 4 are front and side views of the in-line skating boot of FIG. 1.
FIG. 5 is an enlarged view of a portion of FIG. 3, illustrating how the ice skating blade of FIGURE is retained in position.
FIGS. 6–13 are helpful in an understanding of the invention embodying the FIG. 1 construction.

Thus, and as more particularly shown in FIGS. 1, 4 and 3, the assembly 14 is modified to include a plurality of discs 20, secured to the assembly 14 in alignment one-behind-the-other with each of the discs 20 including two separable sections 22 with an ice skating blade 24 removably insertable between the two half-sections 22 so as to extend forwardly and rearwardly of the discs 20. Thus, and as shown in FIGS. 1 and 4, the ice skating blade 24 extends at least from the last of the plurality of discs (shown at 21) rearwardly therefrom, and forwardly from the first of the plurality of discs (shown by the reference numeral 23). Such ice skating blade may be of the type employed for figure skating (as shown in FIG. 6), or as used in hockey (as shown in FIGS. 1, 4 and 7). As will be seen from FIGS. 5–13, the ice skating blade 24 is inserted between the sections 22, which are then compressed against the blade 24 to hold it in position, locked against side-to-side movement, and against forward and rearward movement. As indicated in FIGS. 1 and 4, this can be accomplished through insertion of a hexagonal bolt which passes through the two half-sections 22, and then tightened for locking the blade in position, or loosened in order to remove the blade. As will be appreciated by those skilled in the art, any type of available fastener can alternatively be employed, as long as its tightening continues to compress the sections 22 against the blade 24.

In particular, FIG. 5 shows an exploded section of that portion of the front view of FIG. 3, denoted by the reference 30. As will be seen, the blade 24 incorporates a notch, shown at 32. Such notch is also shown in the front view of the blade 24 shown in FIG. 8, whose side view is shown in FIG. 7. As will be seen from FIG. 8, the notch 32 extends only on one side of the blade 24, and not on the other side. The notch 32 is shown as having a trough 34, and angled side walls 36, 38.

Figure 10:
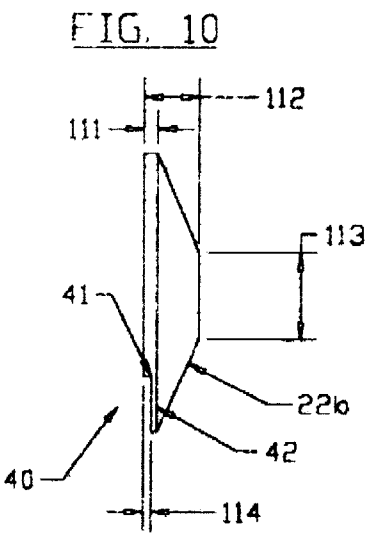
Figure 9:
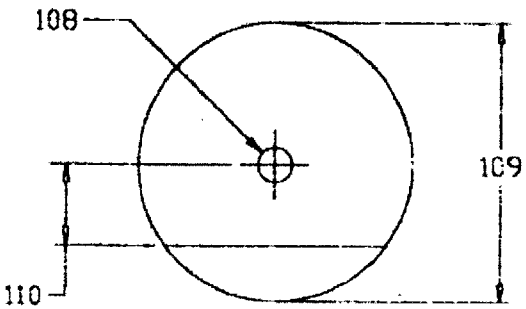

FIGS. 9 and 10 are side and front views, respectively, of that separable section of the plurality of discs shown as 22 in FIG. 3. As will be seen from FIG. 10, the section **22*b* has a notch at its lower end 40, formed of an upper horizontal wall 41 and a vertical wall 42 at a right-angle to it. As shown in FIG. 5 and 8, inserting the blade 24 into the half-section 22*b* is possible with an upward movement of the blade 24, until its top edge 35 bears against the horizontal wall 41, beyond which it cannot be moved, to thereby operate in preventing further upward movement of the blade 24 once it is in position. As is also shown in FIG. 5, the vertical wall 42 of the half-section of FIG. 10 aligns with the right-side edge 37 of the blade (as shown in FIG. 8), so that an inward force from right-to-left in FIG. 5 compresses the vertical wall 42 against the right-side edge 37, in a direction to prevent the blade 24** from side-to-side movement with respect to the right.

Figure 13:
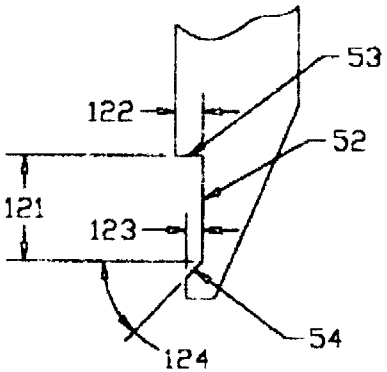
Figure 12:
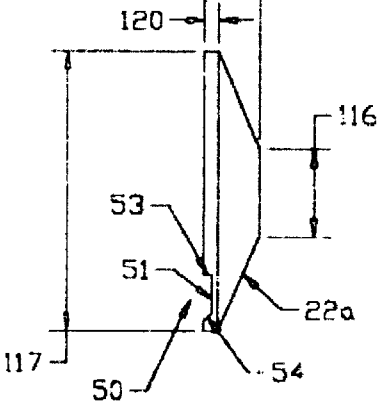
Figure 11:
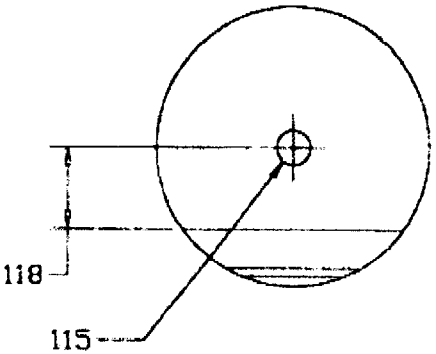

FIGS. 11 and 12, on the other hand, show side and front views of the half-section **22*a* of FIG. 3, with FIG. 13 being an exploded view of the lower section 50 of FIG. 12. As will be noted, this half-section 22*a* is likewise provided with a notch 51, shown (more particularly in FIG. 13) as having a vertical wall 52, a horizontal wall 53 perpendicular to the wall 52, and a further angled wall 54. As also shown in FIG. 5, inserting the blade 24 upwardly between the two sections 22*a*, 22*b* eventually brings the top edge 35 of the blade 24 to bear against the vertical wall 53 in similarly limiting upward movement of the blade 24 between the two sections 22*a*, 22*b*. With similar dimensionings so as to place the walls 41 of FIG. 10 in linear alignment with the wall 53 of FIG. 13, the blade 24 is restricted in further upward movement, at the same position in either half of the disc location. Likewise, and as shown from a consideration of the views of FIGS. 5, 8 and 13, the wall 36 of the notch 32 in blade 24 bears against the wall 54 in the notch 51 so as to hold it in position, with the respective angles being selected to mate, in thereby preventing side-to-side movement of the blade 24 once in position, as well as downward movement of the blade. In a preferred embodiment of the invention, the walls 36, 38 and 54 were cut at 45° angles. As with the section 22*b*, a compressive inward force against the section 22*a* serves to bring, in this case, the vertical wall 52 against the left-side wall 39 of FIG. 8, to hold it in place, against side-to-side movement, or front-to-back movement. Whether the blade 24 be of the type used in ice figure skating (as in FIG. 6), or as in ice hockey (FIGS. 4 or 7), the notch configuration of the blade as shown in FIG. 8, with the notch configurations of the half-sections forming the discs 20 (as shown in FIGS. 10 and 13), thereby hold the ice skating blade in proper position, once the tightening of the fasteners 75 of FIGS. 1 and 4** is completed.

In converting the in-line skate from roller wheel use to ice skating use, then, the procedure could be to remove the individual roller wheels, temporarily attach the two half-sections of each of the plurality of discs to the assembly 14, insert upwardly the blade 24 between the two half-sections **22*a*, 22*b* of each disc 20, and then adjust each fastener in turn. Obviously, loosening each fastener allows the blade to be removed and replaced—as by substituting the figure skating blade for the hockey blade—or in removing each of the plurality of discs 20**, for replacement of the roller wheels for in-line roller skating use.

The embodiment of the invention of FIGS. 2 and 14–19, on the other hand, is more attractive for speed skating. There, the plurality of discs 80 (FIG. 2) are shown as having two separable sections 81, 82 (FIG. 14) and an ice skating blade 83 removably insertable between the sections 81, 82. As an observations of FIGS. 2 and 14 would indicate, in this embodiment a plurality of individual blades are employed, equal in number to the plurality of discs, but of a dimension larger than that of the discs, though of a configuration substantially similar to them. As FIG. 14 will indicate, the disc (composed of the two sections 81, 82) essentially serves to retain the blade 83 in position, when joined by a pair of bearings 84, 85 arranged to join with the discs 81, 82, and with the retaining bolt, or other arrangement, to be inserted at 89 on the assembly 14 (FIG. 2) in joining the various sections together. As FIG. 14 illustrates, one half-section 82 of this embodiment includes an inwardly facing shelf section 87 which passes through an annular opening 88 of the blade 83 for joining with the other half-section 81. Thus, FIGS. 18 and 19 show front and side views respectively of speed skating blade 83 along with its annular opening 88. FIGS. 15 and 17 respectively show left and right-side views of the two half-sections 81, 82, along with the shelf section 87. FIG. 16 shows the front view of the half-section 81, showing its own shelf section 90, on which the central opening 88 of the blade 83 rests, and through which the shelf section 87 of the half-section 82 fits in bearing against the annular blade 83 to lock it in position. As will be appreciated, the bearings 84, 85 allow the blade 83 to rotate during the skating action, with the bearing 84 fitting within the notch 91 cut into the left half-section 81 of the disc 80 as shown.

As with the embodiment of FIG. 1, the embodiment of FIG. 2 compresses the two half-sections 81, 82 against the skating blade in holding it in position against forward and rearward movement, and against side-to-side movement while the bearings 84, 85 permit the blade to rotate.

In this manner, as with the embodiment of FIG. 1, tightening the fastener 89 secures the blades 84 to the assembly 14 for use in in-line ice skating, while loosening the fastener 89 permits the removal of the blades from the assembly, and the reinsertion of the roller wheels for in-line roller skating. In this manner, and in accordance with the invention, the same in-line boot assembly can be used for all of roller skating, ice figure skating, ice hockey and ice speed skating without the need for having to purchase separate skating boots for each individual use.

While Applicant does not wish to be limited to any particular set of values, the following have proven useful in constructing the embodiments of the invention:

| | |
|---|---|
| Dimension 101 | 1.250 inch |
| Dimension 102 | 0.200 inch radius |
| Dimension 103 | 1.000 inch radius |
| Dimension 104 | 0.187 inch |
| Dimension 105 | 0.190 inch |
| Dimension 106 | 0.655 inch |
| Dimension 107 | 45° |
| Dimension 108 | 0.250 inch diameter |
| Dimension 109 | 3.000 inch diameter |
| Dimension 110 | 0.750 inch |
| Dimension 111 | 0.125 inch |
| Dimension 112 | 0.500 inch |
| Dimension 113 | 1.000 inch |
| Dimension 114 | 0.094 inch |
| Dimension 115 | 0.250 inch diameter |
| Dimension 116 | 1.000 inch diameter |
| Dimension 117 | 3.000 inch diameter |
| Dimension 118 | 0.750 inch |
| Dimension 119 | 0.500 inch |
| Dimension 120 | 0.125 inch |
| Dimension 121 | 0.625 inch |
| Dimension 122 | 0.093 inch |
| Dimension 123 | 0.030 inch |
| Dimension 124 | 45° |
| Dimension 125 | 1.500 inch diameter |
| Dimension 126 | 3.000 inch diameter |
| Dimension 127 | 0.188 inch |
| Dimension 128 | 1.500 inch diameter |
| Dimension 129 | 2.250 inch diameter |
| Dimension 130 | 0.250 inch diameter |
| Dimension 131 | 0.625 inch diameter |
| Dimension 132 | 0.750 inch |

-continued

| | |
|---|---|
| Dimension 133 | 0.031 inch |
| Dimension 134 | 0.500 inch |
| Dimension 135 | 0.094 inch |

While there have been described what are considered to be preferred embodiments of the present invention, it will be readily appreciated by those skilled in the art that modifications can be made without departing from the scope of the teachings herein. For at least such reason, therefore, resort should be had to the claims appended for a true understanding of the scope of the invention.

We claim:

1. In in-line skating boots of the type incorporating an assembly in which roller wheels are held in alignment one-behind-another, an ice skating combination for the replacement of said roller wheels, comprising:

a plurality of discs secured to said assembly in substantially similar alignment one-behind-the-other, with each of said plurality of discs including two separable sections, an ice skating blade removably insertable between said separate sections and extending forwardly and rearwardly thereof, and means cooperating with said two sections for exerting pressures against said sections in compressing said sections against said skating blade in holding said blade in position.

2. The combination of claim 1 wherein said ice skating blade extends at least from a last of said plurality of discs to a first of said plurality of discs in said alignment.

3. The combination of claim 1 wherein said ice skating blade extends rearwardly of a last of said plurality of discs and forwardly of a first of said plurality of discs in said alignment.

4. The combination of claim 1 wherein said plurality of discs are composed of two half-sections each,between which said ice skating blade is lockable in position once inserted.

5. The combination of claim 4 wherein each of said two half-sections of said plurality of discs and said ice skating blade are notched, for bearing against one another in locking said ice skating blade in position.

6. The combination of claim 4 wherein each of said two half-sections of said plurality of discs and said ice skating blade are notched for bearing against one another in locking said ice skating blade in position against forward and rearward movement thereof.

7. The combination of claim 4 wherein each of said two half-sections of said plurality of discs and said ice skating blade are notched for bearing against one another in locking said ice skating blade in position against side-to-side movement thereof.

* * * * *